US006074791A

United States Patent [19]

Jennings et al.

[11] Patent Number: 6,074,791

[45] Date of Patent: Jun. 13, 2000

[54] PHOTOCONDUCTIVE IMAGING MEMBERS

[75] Inventors: Carol A. Jennings, Etobicoke; Dasarao K. Murti, Mississauga; Paul F. Smith, Toronto; Gwynne E. McAneney, Burlington; Ah-Mee Hor, Mississauga; Sandra J. Gardner, Oakville; Beng S. Ong, Mississauga, all of Canada

[73] Assignee: Xerox Corporation, Stamford, Conn.

[21] Appl. No.: 09/258,379

[22] Filed: Feb. 26, 1999

[51] Int. Cl.[7] ..... G03G 5/10

[52] U.S. Cl. ..... 430/58.8; 430/59.4; 430/65

[58] Field of Search ..... 430/60, 58.8, 65, 430/59.4

[56] References Cited

U.S. PATENT DOCUMENTS

| | | | |
|---|---|---|---|
| 4,338,390 | 7/1982 | Lu | 430/106 |
| 4,587,189 | 5/1986 | Hor et al. | 430/59 |
| 5,013,624 | 5/1991 | Yu | 430/60 |
| 5,116,703 | 5/1992 | Badesha et al. | 430/58.8 |
| 5,286,591 | 2/1994 | Hongo | 430/60 |
| 5,473,064 | 12/1995 | Mayo et al. | 540/141 |
| 5,482,811 | 1/1996 | Keoshkerian et al. | 430/135 |
| 5,489,496 | 2/1996 | Katayama et al. | 430/62 |
| 5,493,016 | 2/1996 | Burt et al. | 540/139 |
| 5,521,306 | 5/1996 | Burt et al. | 540/141 |
| 5,582,948 | 12/1996 | Ashiya | 430/131 |
| 5,645,965 | 7/1997 | Duff et al. | 430/59 |

OTHER PUBLICATIONS

"Vectorial Electron Injection Into Transparent Semiconductor Membranes and Electric Field Effects on the Dynamics of Light–Induced Charge Separation", B. O'Regan, J. Moser, M. Anderson and M. Grätzel, *J. Phys. Chem.*, vol. 94, pp. 8720–8726 (1990).

"Nanocrystalline Titanium Oxide Electrodes for Photovoltaic Applications", C.J. Barbé, F. Arendse, P. Comte, M. Jirousek, F. Lenzmann, V. Shklover and M. Grätzel, *J. Am. Ceram. Soc.*, vol. 80(12), pp. 3157–3171 (1997).

*Sol–Gel Science*, Chap. 2, Hydrolysis and Condensation I, Nonsilicates, eds. C.J. Brinker and G.W. Scherer (Academic Press Inc., Toronto, 1990), 21–95.

"A Solution Chemistry Study of Nonhydrolytic Sol–Gel Routes to Titania", P. Arnal, R.J.P. Corriu, D. Leclercq, P.H. Muting and A. Vioux, *Chem. Mater.*, vol. 9, pp. 694–698 (1997).

"Synthesis, Structure and Applications of $T10_2$ Gels", J. Livage, *Mat. Res. Soc. Symp. Proc.*, vol. 73, pp. 717–724 (1990).

"Introductory Lecture", P.J. Flory, Faraday Disc., *Chem. Society*, 57, pp. 7–18, 1974.

*Primary Examiner*—John Goodrow

*Attorney, Agent, or Firm*—E. D. Palazzo

[57] ABSTRACT

A photoconductive imaging member comprised of a supporting substrate, a hole blocking layer thereover, a photogenerating layer and a charge transport layer, and wherein the hole blocking layer is comprised of a metal oxide prepared by a sol-gel process.

39 Claims, No Drawings

PHOTOCONDUCTIVE IMAGING MEMBERS

COPENDING APPLICATIONS AND PATENTS

Disclosed in U.S. Pat. No. 5,645,965, the disclosure of which is totally incorporated herein by reference, are photoconductive imaging members with perylenes and a number of charge transport molecules, such as amines.

Illustrated in copending application U.S. Ser. No. 165,595 are photoconductive imaging members with, for example, perylene photogenerating pigments. Photoconductive imaging members with siloxane and related blocking layers are illustrated in U.S. Pat. No. 5,874,193 and U.S. Pat. No. 5,871,877, the disclosure of each being totally incorporated herein by reference.

Illustrated in U.S. Pat. No. 5,493,016, the disclosure of which is totally incorporated herein by reference, are imaging members comprised of a supporting substrate, a photogenerating layer of hydroxygallium phthalocyanine, a charge transport layer, a photogenerating layer of BZP perylene, which is preferably a mixture of bisbenzimidazo (2,1-a-1',2'-b)anthra(2,1,9-def:6,5,10-d'e'f')diisoquinoline-6, 11 -dione and bisbenzimidazo(2,1-a:2',1'-a)anthra(2,1,9-def:6,5, 1 0-d'e'f')diisoquinoline-10, 21-dione, reference U.S. Pat. No. 4,587,189, the disclosure of which is totally incorporated herein by reference; and as a top layer a second charge transport layer.

Also, in U.S. Pat. No. 5,473,064, the disclosure of which is totally incorporated herein by reference, there is illustrated a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components of the above applications and patents may be selected for the present invention in embodiments thereof.

BACKGROUND OF THE INVENTION

This invention is generally directed to imaging members, and more specifically, the present invention is directed to improved multilayered imaging members with a hole blocking layer of metal oxides prepared by sol-gel processes, and which blocking layer is in contact with a supporting substrate and is situated between the supporting substrate and the photogenerating layer, and which photogenerating layer may be comprised of the photogenerating pigments of the patents indicated herein, such as U.S. Pat. No. 5,482,811, the disclosure of which is totally incorporated herein by reference. The imaging members of the present invention in embodiments exhibit excellent cyclic stability, independent layer discharge, and substantially no adverse changes in performance over extended time periods, and also the imaging members are solvent resistant blocking layers, and enable suitable hole blocking layer thickness that can be easily coated on a supporting substrate. The aforementioned photoresponsive, or photoconductive imaging members can be negatively charged when the photogenerating layer is situated between the hole transport layer and the substrate. Processes of imaging, especially xerographic imaging and printing, including digital, are also encompassed by the present invention. More specifically, the invention layered photoconductive imaging members can be selected for a number of different known imaging and printing processes including, for example, electrophotographic imaging processes, especially xerographic imaging and printing processes wherein negatively charged or positively charged images are rendered visible with toner compositions of an appropriate charge polarity. Moreover, the imaging members of this invention are preferably useful in color xerographic applications where several color printings can be achieved in a single pass.

The imaging members as indicated herein are in embodiments sensitive in the wavelength region of, for example, from about 400 to about 900 nanometers, and in particular, from about 700 to about 850 nanometers, thus diode lasers can be selected as the light source.

PRIOR ART

Layered photoresponsive imaging members have been described in a number of U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is substantially incapable of transporting for any significant distance injected charge carriers generated by the photoconductive particles.

There are disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing the dyestuff in a vacuum. Specifically disclosed in this patent are dual layer photoreceptors with perylene-3,4,9,10-tetracarboxylic acid diimide derivatives, which have spectral response in the wavelength region of from 400 to 600 nanometers. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a BZP perylene pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds and the aryl amine charge transport molecules can be selected for the imaging members of the present invention.

In U.S. Pat. No. 4,921,769, the disclosure of which is totally incorporated herein by reference there is illustrated photoconductive imaging members with blocking layers of certain polyurethanes.

Photoconductive imaging members with siloxane blocking layers are illustrated in U.S. Pat. No. 4,464,450, the disclosure of which is totally incorporated herein by reference, and wherein according to the abstract, for example, the siloxane is formed from the reaction product of a hydrolyzed silane. Further, U.S. Pat. No. 4,579,801, discloses a photoconductive subbing layer comprised of a dispersion of a conductive component, such as titanium oxide, or rutile, in a phenolic resin. The size of the titanium dioxide selected is, for example, from 0.1 to about 0.6 micron.

Other patents relating to photoconductive imaging members with hole blocking layers are U.S. Pat. No. 5,489,496, which discloses an undercoating layer of needle like titanium oxide particles with, for example, an aspect ratio of about 1.5, U.S. Pat. No. 5,286,591, which illustrates a subbing layer of an organic chelate or an organic oxide and a hygroscopic compound with two carboxyl groups per molecule, and U.S. Pat. No. 5,582,948 discloses an undercoating of at least one zirconium alkoxide, zirconium chelate, and a silane coupling agent. After the undercoating layer of U.S. Pat. No. 5,582,948 is applied and dried, water is be supplied from outside the film to complete the hydrolysis and polymerization.

Advantages of the present invention over the above prior art includes, for example, the provision of blocking layers with small sized components, for example nanometer in size, that is from about 1 to about 1,000 nanometers in diameter, and preferably from about 5 to about 100 nanometers in diameter, the enablement of transparent blocking layer components (transparent refers for example to absorbance of less than about 0.2 absorbance units in the region of about 400 to about 900 nanometers as measured in a spectrophotometer) blocking layers that can be >0.5 micron thick to thereby improve coating uniformity, solutions containing nanocrystalline sols that are extremely stable with time, up to six months for instance due primarily to the small particle size thereof, avoidance of grinding to reduce particle size synthesis from molecular precursors which provides control over the introduction of impurities, and wherein synthetic conditions can be changed to obtain various crystal forms and particle sizes and different loadings of nanocrystalline sol in polymeric binder can be used to achieve different conductivities in the blocking layer. It is important that the charge blocking layer bleeds off the negative charge while preventing positive charge leakage.

Although insulating type polymers can efficiently block hole injection from the underlying ground plane, their maximum thickness is usually limited by the inefficient transport of the photoinjected electrons from the generator layer to the substrate. When a charge blocking layer is thick, for example, greater than or equal to about 0.4 micron, for example 0.4 micron to 10 microns, the resistivity of the layer usually increases and blocks passage of both negative and positive charges. Thus, the charge blocking coating should preferably be very thin, for example less than about 0.1 micron, and more specifically from about 0.02 to about 0.09 micron, and which thin blocking layer coating often presents still another problem, that is the incomplete coverage of the underlying substrate due to inadequate wetting on localized unclean substrate surface areas. Coating thickness nonuniformity can result in charge leakage. Further, blocking layers that are too thin, for example less than about 0.5 micrometer, and more specifically, from about 0.02 to 0.40 micron in thickness, are more susceptible to the formation of pinholes which allow both negative and positive charges to leak through the charge blocking and result in print defects. Also, when charge blocking layers are too thin, small amounts of contaminants can adversely affect the performance of the charge blocking layer and cause print defects due to passage of both negative and positive charges through the layer. Defects in hole blocking layer which allow positive charges to leak through lead to the development of charge deficient spots associated with copy printout defects. These and other disadvantages can be avoided, or minimized with the imaging members of the present invention.

SUMMARY OF THE INVENTION

It is a feature of the present invention to provide imaging members thereof with many of the advantages illustrated herein.

Another feature of the present invention relates to the provision of improved layered photoresponsive imaging members with photosensitivity of, for example, about 400 to about 900 nanometers.

It is yet another feature of the present invention to provide improved layered photoresponsive imaging members which possess improved electricals and improved coating characteristics, and wherein the charge transport molecules do not diffuse, or there is minimum diffusion thereof into the photogenerating layer.

Moreover, another feature of the present invention relates to the provision of layered photoresponsive imaging members with durable, and solvent resistant hole blocking layers, and which layers, or layer can be thicker than present similar layers of, for example, 0.6 micron, and which layers enable electron transport and avoid, or minimize residual charge buildup.

In a further feature of the present invention there are provided imaging members containing photogenerating pigments of Type V hydroxygallium phthalocyanine, especially with XRPD peaks at, for example, Bragg angles (2 theta ±0.2°) of 7.4, 9.8, 12.4, 16.2, 17.6, 18.4, 21.9, 23.9, 25.0, 28.1, and the highest peak at 7.4 degrees. The X-ray powder diffraction traces (XRPDs) were generated on a Philips X-Ray Powder Diffractometer Model 1710 using X-radiation of CuK-alpha wavelength 0.1542 nanometer. The diffractometer was equipped with a graphite monochromator and pulse-height discrimination system. Two-theta is the Bragg angle commonly referred to in x-ray crystallographic measurements. I (counts) represents the intensity of the diffraction as a function of Bragg angle as measured with a proportional counter.

Aspects of the present invention relate to a photoconductive imaging member comprised of a supporting substrate, a hole blocking layer thereover, a photogenerating layer and a charge transport layer, and wherein the hole blocking layer is comprised of a metal oxide prepared by a sol-gel process; a member wherein the sol is nanocrystalline and contains particles of a size of from about 1 to about 1,000 nanometers; a member wherein the nanocrystalline sol contains particles of a size of from about 100 to about 500 nanometers in diameter as measured by transmission electron microscopy; a member wherein the hole blocking layer is comprised of about 1 to about 100 percent by weight of nanocrystalline metal oxide particles of a diameter of from about 1 to about 1,000 nanometers and from about 0.5 to about 99 percent by weight of a polymeric binder; a member wherein the hole blocking layer generated by the sol-gel process is comprised of about 30 to about 70 percent by weight of the metal oxide and about 30 to about 70 percent by weight of a polymeric binder; a member wherein the hole blocking layer is of a thickness of about 0.1 to about 5 microns; a wherein the hole blocking layer is of a thickness of about 1 to about 2 microns; a member wherein the photogenerating layer is comprised of phthalocyanines, perylenes, dibromoanthranthone, azo pigments, or selenium; a member wherein the photogenerating layer is comprised of metal free phthalocyanines, metal phthalocyanines, titanyl phthalocyanines, hydroxygallium phthalocyanines, or alkoxide gallium phthalocyanines; a member wherein the photogenerating layer is comprised of perylenes, benzimidazole perylene or perylene dimers; a photoconductive imaging member comprised in the following sequence of a supporting substrate, the hole blocking layer, the photogenerating layer and the charge transport layer; an imaging member wherein the supporting substrate is comprised of a conductive substrate comprised of a metal; an imaging member wherein is the conductive substrate is aluminum, aluminized polyethylene terephthalate or titanized polyethylene terphthalate, metallized plastics or transparent conductive substrates; an imaging member wherein the photogenerator layer is of a thickness of from about 0.05 to about 10 microns; an imaging member wherein the transport layer is of a thickness of from about 10 to about 50 microns; an imaging member wherein the photogenerating layer is comprised of photogenerating pigments dispersed in a resinous binder, and wherein the pigments are present in an amount of from about 5 percent by weight to about 95 percent by weight; an imaging member wherein the resinous binder is selected from the group consisting of polyesters, polyvinyl butyrals, polycarbonates, polystyrene-b-polyvinyl pyridine, and polyvinyl formals; an imaging member wherein the charge transport layer comprises aryl amine molecules; an imaging member wherein the charge transport layer is comprised of amines of the formula

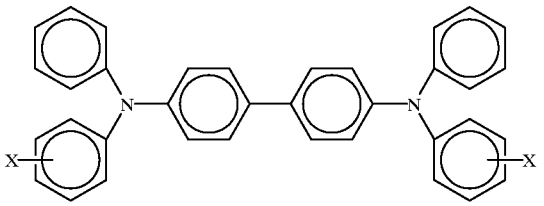

wherein X is selected from the group consisting of alkyl and halogen, and wherein the the amine is optionally dispersed in a highly insulating and transparent resinous binder; an imaging member wherein alkyl contains from about 1 to about 10 carbon atoms; an imaging member wherein alkyl contains from 1 to about 5 carbon atoms; an imaging member wherein alkyl is methyl, wherein halogen is chloride, and wherein the resinous binder is selected from the group consisting of polycarbonates and polystyrenes; an imaging member in accordance with claim 19 wherein the aryl amines are molecules comprised of N,N'-diphenyl-N, N-bis(3-methyl phenyl)-1,1'-biphenyl-4,4'-diamine; an imaging member further including an adhesive layer in contact with the hole blocking layer, and which adhesive layer is comprised of a polyester; a member wherein the polyester possesses an $M_w$ of about 69,000, and an $M_n$ of from about 10,000 to about 100,000; an imaging member wherein the photogenerating layer is comprised of Type V hydroxygallium phthalocyanine; a method of imaging which comprises generating an electrostatic latent image on the imaging member, developing the latent image, and transferring the developed electrostatic image to a suitable substrate; a photoconductive imaging member comprised in sequence of a supporting substrate, a hole blocking layer thereover, a photogenerating layer and a charge transport layer, and wherein the hole blocking layer is comprised of a nanocrystalline metal oxide particles prepared by a sol-gel process; a member wherein the hole blocking layer prepared by the sol-gel process is comprised of about 1 to about 100 percent by weight of nanocrystalline metal oxide particles of about 1 to about 1,000 nanometers in diameter, and which particles are present in a polymeric binder, and wherein the metal oxides are comprised of the transition metals of scandium (Sc), titanium (Ti), vanadium (V), chromium (Cr), manganese (Mn), iron (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), mercury (Hg), unnilquadium (Unq), unnilpentium (Unp) and unnilhexium (Unh inner transition elements of lanthanides of lanthanum (La) cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu); actinides of actinium (Ac), thorium (Th), protactinium (Pa), uranium (U), neptunium (Np), plutonium (Pu), americium (Am), curium (Cm), berkelium (Bk), californium (Cf), einsteinium (Es), fermium (Fm), mendelevium (Md), nobelium (No) and lawrencium (Lr); perovskites of $SrTiO_3$, $CaTiO_3$; oxides of metals of the second main group (of the periodic system of elements) of beryllium (Be), magnesium (Mg), calcium (Ca), strontium (Sr), barium (Ba), radium (Ra) and the third main group (of the periodic system of elements) of boron (B), aluminum (Al), gallium (Ga), indium (In) and thallium (Tl); a member wherein the oxide is titanium dioxide; a member wherein the oxide is anatase titanium dioxide; a member wherein the polymeric binder is an acrylic polymer of poly(acrylic acid), a polyimine, poly(ethylene oxide), poly(ethylene glycol), poly(propylene oxide) or poly(propylene glycol), a polyalcohol of poly(vinyl alcohol), a polyether, a polyester, a silicone, a polycarbonate, a polyamide of nylon, vinyl polymers of poly(vinyl butyral), vinylidene chloride, vinyl chloride-vinyl acetate copolymer, ethylene-vinyl acetate copolymer, poly(vinylpyrrolidone), poly(vinylpyrridine), hydroxypropyl cellulose, methyl cellulose and ethyl cellulose, starch, polysaccharides or proteins; a member wherein the binder is a vinyl polymer of poly(vinyl alcohol), or poly(vinylbutyral); imaging members with sol-gel blocking, or undercoating layers which are in contact with a supporting substrate and a photogenerating layer; and photoconductive imaging members comprised in sequence of a supporting substrate, a sol-gel blocking layer thereover, a photogenerating layer of for example, hydroxygallium phthalocyanine, and a charge transport layer.

Of importance with respect to the present invention is the hole blocking layer which is comprised of a nanocrystalline metal oxide semiconductor prepared by sol-gel processes.

The sol-gel process comprises for example the preparation of the sol, gelation of the sol, and removal of the solvent. The preparation of a metal oxide sol is disclosed in, for example, B. O'Regan, J. Moser, M. Anderson and M. Gr ätzel, *J. Phys. Chem.*, vol. 94, pp. 8720–8726 (1990), C. J. Barbé, F. Arendse, P. Comte, M. Jirousek, F. Lenzmann, V. Shklover and M. Grätzel, *J. Am. Ceram. Soc.*, vol. 80(12), pp. 3157–3171 (1997), Sol-Gel *Science,* eds. C. J. Brinker and G. W. Scherer (Academic Press Inc., Toronto, 1990), 21–95, U.S. Pat. No. 5,350,644, M. Graetzel, M. K. Nazeeruddin and B. O'Regan, Sep. 27, 1994, P. Arnal, R. J. P. Corriu, D. Leclercq, P. H. Mutin and A. Vioux, *Chem. Mater.*, vol. 9, pp. 694–698 (1997), the disclosure of which are totally incorporated herein by reference. Chemical additives can be reacted with a precursor such as titanium alkoxide to modify the hydrolysis-condensation reactions during sol preparation and which precursors have been disclosed in J. Livage, *Mat. Res. Soc. Symp. Proc.,* vol. 73, pp. 717–724 (1990), the disclosure of which is totally incorporated herein by reference. Sol refers for example, to a colloidal suspension, from about 1 to about 1,000 nanometers in diameter, solid particles, in a liquid, reference P. J. Flory, Faraday Disc., *Chem. Society,* 57, pages 7–18 for example, 1974, and gel refers, for example, to a continuous solid skeleton enclosing a continuous liquid phase, both phases being of colloidal dimensions, or sizes. A gel can be formed also by covalent bonds or by chain entanglement.

Nanocrystalline refers to materials that have a diameter on the order of nanometers, for example from about 1 to about 1,000 nanometers and preferably from about 1 to about 100 nanometers and there is a repeating or periodic structure (crystalline). A sol can be considered a colloidal suspension of solid particles in a liquid, and wherein the gel comprises continuous solid and fluid phases of colloidal dimensions, with a colloid being comprised of a suspension where the dispersed phase is approximately 1 to 1,000 nanometers in diameter. As the gel is dried and solvent removed, a film is obtained. The sol-gel process has been described in Sol-Gel *Sciences,* eds. C. J. Brinker and G. W. Scherer (Academic Press Inc., Toronto, 1990), the disclosure of which is totally incorporated herein by reference.

A first step in the preparation of the sol-gel blocking layer is to prepare the sol. Typically, there is hydrolyzed a metal alkoxide such as titanium (IV) isopropoxide. Examples of metal alkoxides are aluminum n-butoxide, aluminum t-butoxide, aluminum ethoxide, aluminum isopropoxide, barium isopropoxide, calcium ethoxide, cerium IV t-butoxide, cerium IV isopropoxide, chromium III isopropoxide, copper II ethoxide, iron III ethoxide, lanthanum isopropoxide, niobium V n-butoxide, niobium V ethoxide, silicon tetraethoxide, tin II ethoxide, tin IV t-butoxide, titanium ethoxide, titanium isobutoxide, titanium methoxide, titanium n-propoxide, tantalum V ethoxide, tantalum V n-butoxide, tantalum V methoxide, tungsten V ethoxide, vanadium triisopropoxide oxide, vanadium tri-n-propoxide oxide, yttrium isopropoxide, zirconium n-butoxide, zirconium ethoxide, zirconium isopropoxide and zirconium n-propoxide. The hydrolysis can be accomplished for instance by adding a mixture of the metal alkoxide like titanium (IV) isopropoxide and an alcohol, such as 2-propanol from an addition funnel dropwise. Nitric acid is then added and stirring continued. Also, the hydrolysis can be specifically accomplished by pouring a mixture of 119.4 grams of titanium (IV) isoproxide and 15.70 grams of 2-propanol in one step into 750 grams of deionized water in a 1 liter flask while stirring vigorously for about ten minutes. Subsequently, 5.7 milliliters of 65 percent by weight nitric acid is added to the contents of the flask and the flask contents are stirred for ten minutes. Thereafter there is accomplished a hydrothermal condensation. After addition of nitric acid, the mixture in the 1 liter flask is refluxed for 8 hours at 80° C. while stirring. The contents of the flask can be concentrated by removing the solvent using a rotary evaporator. The sol can be dispersed in a solvent by sonification and concentrated by rotary evaporation for instance. The resulting sol, which can be transported through a gel state before being dried, is from about 1 to 1,000 nanometers in diameter and preferably from about 5 to about 100 nanometers in diameter.

Generally, the process of preparation of the sol preferably involves modification of the precursor, such as titanium alkoxide with, for example, a suitable acid, such as acetic acid, 2) hydrolysis and 3) condensation. Examples of sols are metal oxides like titanium dioxide.

Thereafter, a coating solution of the sol can be prepared, containing solvent, binder and stabilizers as indicated herein. For example, 17.48 percent by weight of titanium dioxide sol [prepared in Example IV] is diluted by mixing 11.47 grams of the 17.48 percent concentrate with 2.00 grams of poly(ethylene) glycol and 26.62 grams of deionized water, thereby generating a 10 percent by weight total solid solution with 50 percent by weight of titanium dioxide and 50 percent by weight of poly(ethylene)glycol. As a second specific example, a concentrated 23.7 percent by weight titanium dioxide sol was diluted by mixing 6.77 grams of the 23.7 percent by weight titanium dioxide sol with 2.40 grams of poly(ethylene)glycol and 30.88 grams of deionized water generating a solution that was 10 percent by weight total solids of 40 percent by weight titanium dioxide and 60 percent by weight poly(ethylene)glycol. Thirdly, a 23.7 percent by weight titanium dioxide sol was diluted by mixing 5.07 grams of this 23.7 percent sol with 2.80 grams of poly(ethylene)glycol and 32.14 grams of deionized water resulting in a solution of 10 percent by weight total solids with 30 percent by weight of titanium dioxide and 70 percent by weight of poly(ethylene)glycol. The coating solution may contain from about 0.1 to about 99 percent by weight of total solids content, and more preferably, about 1 to about 20 percent by weight total solid and water. The coating solution can be coated onto a conductive substrate such as aluminum, aluminized polyethylene terephthalate, titanized polyethylene terephthalate, metallized plastics or transparent conductive plastic by means known to those skilled in the art, such as spin coating, coating with wire-wound rods, gravure, doctor blade, solution coating onto a web using a die, spray or dip coating onto a suitable substrate.

The sol-gel film can be specifically prepared by coating from a 10 percent by weight total solids solution of a 50:50, 40:60 and 30:70 percent by weight ratio of titanium dioxide to poly(ethylene)glycol respectively in the solid, the remainder being solvent, typically deionized water and possibly an alcohol. The sol-gel film is preferably dried at a suitable temperature in the range of about 60° C. to about 500° C. to remove the solvent most commonly water or an alcohol. When the substrate is a plastic, lower temperatures are used, for example up to about 135° C.; when the substrate is a conductive glass or metal drum, higher temperatures up to 500° C. are selected. Alternatively, a sol precursor solution of a metal alkoxide in a solvent can be applied to the substrate so that hydrolysis, condensation and drying are accomplished on the substrate. Sol-gel blocking layers were coated with dry thicknesses of about 0.3 to about 2.2 microns, the preferred dry thickness being about 0.6 micron.

The resulting dry sol-gel film is comprised of about 1 to about 100 percent by weight nanocrystalline metal oxides where nanocrystalline refers to materials that have a diameter on the order of nanometers (nano) of from about 1 to about 1,000 nanometers, and preferably from about 1 to about 100 nanometers, and there is a repeating or periodic structure (crystalline) and preferably from about 40 to about 60 percent by weight metal oxide and about 40 to about 60 percent by weight binder. More preferably, the sol-gel dry film is comprised of about 30 to about 70 percent by weight of a nanocrystalline metal oxide and about 30 to about 70 percent by weight polymeric binder. Particularly suitable metal oxide semiconductors are as illustrated, for example, in U.S. Pat. No. 4,927,721, the disclosure of which is totally incorporated herein by reference, and more specifically oxides of the transition metals: scandium (Sc), titanium (Ti), vanadium (V), chromium (Cr), manganese (Mn), iron (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), mercury (Hg), unnilquadium (Unq), unnilpentium (Unp) and unnilhexium (Unh). Also suitable are oxides of lanthanides and actinides. The lanthanides and actinides are known as the inner transition elements. The lanthanides are: lanthanum (La) cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). The actinides are: actinium (Ac), thorium (Th), protactinium (Pa), uranium (U), neptunium (Np), plutonium (Pu), americium (Am), curium (Cm), berkelium (Bk), californium (Cf), einsteinium (Es), fermium (Fm), mendelevium (Md), nobelium (No) and lawrencium (Lr). Also suitable are perovskites such as $SrTiO_3$, $CaTiO_3$ or oxides of other metals of the second main group (of the periodic system of elements): beryllium (Be), magnesium (Mg), calcium (Ca), strontium (Sr), barium (Ba), radium (Ra) and the third main group (of the periodic system of elements): boron (B), aluminum (Al), gallium (Ga), indium (In) and thallium (Tl) or mixed oxides or oxide mixtures of these metals.

Binder examples include poly(ethylene)glycol, poly(vinyl alcohol), hydroxypropylcellulose, poly(vinyl pyridine), poly (acrylic acid), methyl cellulose, ethyl cellulose, celluloses in general, polyamides, poly(vinylbutyral), phenolic resin, ethylene-vinyl acetate copolymer, poly(vinyl pyrrolidone), polycarbonate, polyester, polycarbonate, polyacrylate, polyarylate, polyimide, vinylidene chloride, vinyl chloride-vinyl acetate copolymers, casein, gelatin, and the like.

In general, the binder should adhere well to the substrate and be compatible with the subsequently deposited charge generation layer, and there should be good adhesion to the charge generation layer.

Examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and many have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness is providing there are no adverse effects on the system. In one embodiment, the thickness of this layer is from about 75 microns to about 300 microns.

The photogenerating layer, which is preferably comprised of hydroxygallium phthalocyanine Type V, is in embodiments comprised of, for example, about 50 weight percent of the Type V and about 50 weight percent of a resin binder like polystyrene/polyvinylpyridine. The photogenerating layer can contain known photogenerating pigments, such as metal phthalocyanines, metal free phthalocyanines, hydroxgallium phthalocyanines, perylenes, especially BZP, titanyl phthalocyanines, and the like, and more specifically vanadyl phthalocyanines, Type V hydroxygallium phthalocyanines, and inorganic components such as selenium, especially trigonal selenium. The photogenerating pigment can be dispersed in a resin binder, similar to the resin binders selected for the charge transport layer, as recited hereinafter, for example, or alternatively no resin binder is needed.

Generally, the thickness of the photogenerator layer depends on a number of factors, including the thicknesses of the other layers and the amount of photogenerator material contained in these layers. Accordingly, each layer can be of a thickness of, for example, from about 0.05 micron to about 10 microns, and more specifically, from about 0.25 micron to about 1 micron when, for example, each of the photogenerator compositions is present in an amount of from about 30 to about 75 percent by volume. The maximum thickness of the layers in an embodiment is dependent primarily upon factors, such as photosensitivity, electrical properties and mechanical considerations. The photogenerating layer binder resin, present in various suitable amounts, for example from about 1 to about 20, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. In embodiments of the present invention, it is desirable to select a coating solvent that does not disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns and preferably from about 0.1 to about 15 microns after being dried at, for example, about 40° C. to about 150° C. for about 5 to about 90 minutes.

Illustrative examples of polymeric binder materials that can be selected for the photogenerator pigments are as indicated herein, and include those polymers as disclosed in U.S. Pat. No. 3,121,006, the disclosure of which is totally incorporated herein by reference.

As optional adhesives usually in contact with the hole blocking layer, there can be selected various known substances inclusive of polyesters, polyamides, poly(vinyl butyral), poly(vinyl alcohol), polyurethane and polyacrylonitrile. This layer is of a thickness of from about 0.001 micron to about 1 micron. Optionally, this layer may contain effective suitable amounts, for example from about 1 to about 10 weight percent, conductive and nonconductive particles, such as zinc oxide, titanium dioxide, silicon nitride, carbon black, and the like, to provide, for example, in embodiments of the present invention further desirable electrical and optical properties.

Aryl amines selected for the hole transporting layers, which generally are of a thickness of from about 5 microns to about 75 microns, and preferably of a thickness of from about 10 microns to about 40 microns, include molecules of the following formula

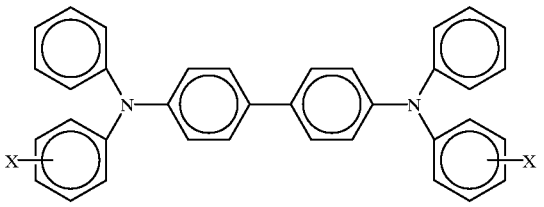

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of the highly insulating and transparent polymer binder material for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Alkoxy-bridged Gallium Phthalocyanine Dimer Synthesis Using Gallium Methoxide Obtained From Gallium Chloride and Sodium Methoxide In Situ To a 1 liter round bottomed flask were added 25 grams of $GaCl_3$ and 300 milliliters of toluene, and the mixture was stirred for 10 minutes to form a solution. Then, 98 milliliters of a 25 weight percent sodium methoxide solution (in methanol) were added while cooling the flask with an ice bath to keep the contents below 40° C. Subsequently, 250 milliliters of ethylene glycol and 72.8 grams of o-phthalodinitrile were added. The methanol and toluene were quickly distilled off over 30 minutes while heating from 70° C. to 135° C., and then the phthalocyanine synthesis was performed by heating at 195° C. for 4.5 hours. The alkoxy-bridged gallium phthalocyanine dimer was isolated by filtration at 120° C. The product was then washed with 400 milliliters of DMF at 100° C. for 1 hour and filtered. The product was then washed with 600 milliliters of deionized water at 60° C. for 1 hour and filtered. The product was then washed with 600 milliliters of methanol at 25° C. for 1 hour and filtered. The product was dried at 60° C. under vacuum for 18 hours. The alkoxy-bridged gallium phthalocyanine dimer, 1,2-di(oxogallium phthalocyaninyl) ethane, was isolated as a dark blue solid in 77 percent yield. The dimer product was characterized by elemental analysis, infrared spectroscopy, $^1$NMR spectroscopy and X-ray powder diffraction. Elemental analysis showed the presence of only 0.10 percent of chlorine. Infrared spectroscopy: major peaks at 573, 611, 636, 731, 756, 775, 874, 897, 962, 999, 1069, 1088, 1125, 1165, 1289, 1337, 1424, 1466, 1503, 1611, 2569, 2607, 2648, 2864, 2950, and 3045 $cm^{-1}$; $^1$H NMR spectroscopy (TFA-d/$CDCl_3$ solution, 1:1 v/v, tetramethylsilane reference): peaks at 4.00 (4H), 8.54 (16H), and 9.62 (16H); X-ray powder diffraction pattern: peaks at Bragg angles (2 theta ±0.2°) of 6.7, 8.9, 12.8, 13.9, 15.7, 16.6, 21.2, 25.3, 25.9, and 28.3 with the highest peak at 6.7 degrees.

EXAMPLE II

Hydrolysis of Alkoxy-bridcied Gallium Phthalocyanine to Hydroxygallium Phthalocyanine (Type I)

The hydrolysis of alkoxy-bridged gallium phthalocyanine synthesized in Example I to hydroxygallium phthalocyanine was performed as follows. Sulfuric acid (94 to 96 percent, 125 grams) was heated to 40° C. in a 125 milliliter Erlenmeyer flask, and then 5 grams of the chlorogallium phthalocyanine were added. Addition of the solid was completed in approximately 15 minutes, during which time the temperature of the solution increased to about 48° C. The acid solution was then stirred for 2 hours at 40° C., after which it was added in a dropwise fashion to a mixture comprised of concentrated (30 percent) ammonium hydroxide (265 milliliters) and deionized water (435 milliliters), which had been cooled to a temperature below 5° C. The addition of the dissolved phthalocyanine was completed in approximately 30 minutes, during which time the temperature of the solution increased to about 40° C. The reprecipitated phthalocyanine was then removed from the cooling bath and allowed to stir at room temperature for 1 hour. The resulting phthalocyanine was then filtered through a porcelain funnel fitted with a Whatman 934-AH grade glass fiber filter. The resulting blue solid was redispersed in fresh deionized water by stirring at room temperature for 1 hour and filtered as before. This process was repeated at least three times until the conductivity of the filtrate was <20 $\mu$S. The filter cake was oven dried overnight at 50° C. to give 4.75 grams (95 percent) of Type I HOGaPc, identified by infrared spectroscopy and X-ray powder diffraction, XRPD. The X-ray powder diffraction traces (XRPDs) were generated on a Philips X-Ray Powder Diffractometer Model 1710 using X-radiation of CuK-alpha wavelength (0.1542 nanometer). The diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Infrared spectroscopy: major peaks at 507, 573, 629, 729, 756, 772, 874, 898, 956, 984, 1092, 1121, 1165, 1188, 1290, 1339, 1424, 1468, 1503, 1588, 1611, 1757, 1835, 1951, 2099, 2207, 2280, 2384, 2425, 2570, 2608, 2652, 2780, 2819, 2853, 2907, 2951, 3049 and 3479 (broad) $cm^{-1}$; X-ray diffraction pattern: peaks at Bragg angles of 6.8, 13.0, 16.5, 21.0, 26.3 and 29.5 with the highest peak at 6.8 degrees (2 theta ±0.2°).

EXAMPLE III

Conversion of Type I Hydroxygallium Phthalocyanine to Tvpe V

The Type I hydroxygallium phthalocyanine pigment obtained in Example II was converted to Type V HOGaPc as follows. The Type I hydroxygallium phthalocyanine pigment (3.0 grams) was added to 25 milliliters of N,N-dimethylformamide in a 60 milliliter glass bottle containing 60 grams of glass beads (0.25 inch in diameter). The bottle was sealed and placed on a ball mill overnight (18 hours). The solid was isolated by filtration through a porcelain funnel fitted with a Whatman GF/F grade glass fiber filter, and washed in the filter using several 25 milliliter portions of acetone. The filtered wet cake was oven dried overnight at 50° C. to provide 2.8 grams of Type V HOGaPc which was identified by infrared spectroscopy and X-ray powder diffraction. Infrared spectroscopy: major peaks at 507, 571, 631, 733, 756, 773, 897, 965, 1067, 1084, 1121, 1146, 1165, 1291, 1337, 1425, 1468, 1503, 1588, 1609, 1757, 1848, 1925, 2099, 2205, 2276, 2384, 2425, 2572, 2613, 2653, 2780, 2861, 2909, 2956, 3057 and 3499 (broad) $cm^{-1}$; X--ray diffraction pattern: peaks at Bragg angles of 7.4, 9.8, 12.4, 12.9, 16.2, 18.4, 21.9, 23.9, 25.0 and 28.1 with the highest peak at 7.4 degrees (2 theta ±0.2°).

A photoconductive imaging member can be prepared as follows:

A hole transporting layer solution was prepared by dissolving 2.64 grams of N,N'-diphenyl-N,N-bis(3-methyl phenyl)-1,1'-biphenyl-4,4'-diamine, and 3.5 grams of polycarbonate in 40 grams of dichloromethane. The solution was coated onto the HOGaPc generator layer coated on a sol gel hole blocking layer using a 6 mil film applicator. The charge transporting layer thus obtained was dried at from 100° C. to 135° C. for 20 minutes to provide a final thickness of about 15 microns. The hydroxy gallium Type V photogenerator layer was prepared by milling 0.40 gram of Type V pigment mixture, 0.1 gram of polycarbonate, and 8.00 grams of tetrahydrofuran in a 30 milliliter bottle containing 70 grams of ⅛ inch stainless steel balls. The milling time was for 5 days. The dispersion was diluted and coated with a 2 mil applicator and the coated device was dried at from 100° C. to 135° C. for 20 minutes.

EXAMPLE IV

Titanium Dioxide Sol-gel Blocking Layer 0.37 Micron Thick, 50 Percent by Weight Titanium Dioxide, 50 Percent by Weight Poly(ethylene glycol)

A sol was prepared according to the method of B. O'Regan, J. Moser, M. Anderson and M. Gratzel, *J Phys. Chem.,* vol. 94, pp. 8720–8726 (1990), the disclosure of which is totally incorporated herein by reference. 15.70 Grams of reagent grade 2-propanol available from Caledon were added to a 250 milliliter addition funnel in a glove box which had desiccant and a nitrogen atmosphere. 119.4 Grams of 97 percent titanium (IV) isopropoxide from Aldrich were added to the 2-propanol in the funnel. The resulting solution was a clear faint yellow color. The funnel was sealed with a ground glass stopper and removed from the glove box. The titanium (IV) isopropoxide and 2-propanol in the funnel were added dropwise to a 1 liter Erlenmeyer flask containing 750 grams of 18MΩ.cm deionized water while stirring vigorously for ten minutes with a magnetic stirring bar. A white precipitate was formed as the solution contacted the water. 5.7 Milliliters of 65 percent nitric acid available from Fluka was added to the mixture which included the precipitate and other contents in the Erlenmeyer flask. The resulting solution was refluxed at 80° C. for 8 hours with stirring and a condenser present. The resulting solution was divided into two fractions each approximately 442 grams and concentrated in a 1 liter pear-shaped flask using a rotary evaporator which had a water aspirator to provide a vacuum. The flask was heated in the water bath up to 40° C. The concentrated sol solution contained 17.48 percent by weight of solids, and 82.12 percent water. The solid content was determined by weighing a known amount of liquid into a dish, drying in a vacuum oven and weighing the resulting solid.

A solution of 40.00 grams total mass and 10.00 percent by weight total solids was prepared by magnetically stirring 2.00 grams of polymer binder poly(ethylene)glycol of molecular weight 18,500 from Polysciences, 11.47 grams of a 17.48 percent by weight titanium dioxide sol prepared by the above method and 26.62 grams of 18MΩ.cm deionized water. The solid, therefore, was 50 percent by weight of titanium dioxide and 50 percent by weight of poly(ethylene) glycol. The resulting solution was is coated onto a substrate of vacuum evaporated titanium on 3 mil poly(ethylene terephthalate). A GARDCO® wet-film wire wound applicator rod available from Paul N. Gardner Company Ltd. was used to apply the solution to the substrate. The solution was added to the substrate which was titanium coated polyethylene terephthalate 3 mil thick, using a disposable pipet near the rod and a draw-down was completed. The resulting hole blocking film contained 50 percent by weight of titanium dioxide and 50 percent by weight of poly(ethylene glycol) and was then air dried and then dried in a convection oven for 20 minutes at 135° C. The hole blocking layer thickness measured on a Heidenhain MT60M with digital display was 0.37 micron.

A photoconductive imaging member was then prepared as follows:

The dispersion for the charge generation layer was prepared by combining 0.5 gram of Type V hydroxygallium phthalocyanine as obtained in U.S. Pat. No. 5,521,306, or more specifically as obtained above, and 0.263 gram of a polystyrene/polyvinylpyridine resin ASVP in 17.4 grams of toluene with 70 grams of glass beads (about 0.8 millimeter in diameter). A paint shaker was used for 2 hours to prepare the dispersion. The charge generation layer was then coated on top of the above preferred hole blocking layer of titanium dioxide and poly(ethylene glycol) using a rectangular coating blade from Paul N. Gardner Company Ltd. to provide an optical density of about 1.0. After coating the charge generation layer, the device was dried at 1 15° C. for 20 minutes.

The solution for the charge transport layer comprised 2.0 grams of N,N'-diphenyl-N,N-bis(3-methyl phenyl)-1,1'-biphenyl-4,4'-diamine, 2.0 grams of MAKROLON® polycarbonate and 20.0 grams of dichloromethane. The charge transport layer was then coated on the above prepared photogenerating layer using a Paul N. Gardner Company Ltd. rectangular blade and was dried at 115° C. for 60 minutes. The charge transport layer thickness was about 24 microns.

EXAMPLE V

Titanium Dioxide Sol-gel Blocking Layer 0.59 Micron Thick, 50 Percent by Weight Titanium Dioxide, 50 Percent by Weight Poly(ethylene glycol)

The titanium dioxide sol and coating solution was prepared as in Example IV, and the dry thickness of the coated blocking layer was 0.59 micron as measured with a Heidenhain MT60M. The charge generation, and charge transport layers and photoconductive imaging member were prepared as in Example IV.

EXAMPLE VI

Titanium Dioxide Sol-gel Blocking Layer 0.44 Micron Thick, 40 Percent by Weight Titanium Dioxide, 60 Percent by Weight Poly(ethylene glycol)

The titanium dioxide sol was prepared as in Example IV, however, the concentration of the sol solution after rotary evaporation was 23.70 percent by weight solid. A solution of 40.05 grams total mass and 10.00 percent by weight total solids was prepared by magnetically stirring 2.40 grams of poly(ethylene)glycol of molecular weight, $M_w$, 18,500 from Polysciences, 6.77 grams of a 23.70 percent by weight titanium dioxide.

The resulting solution was coated onto a substrate of vacuum evaporated titanium on 3 mil poly(ethylene terephthalate). A GARDCO® wet-film wire wound applicator rod available from Paul N. Gardner Co. Ltd. was used to apply the solution to the substrate. The solution was added to the substrate using a disposable pipet near the rod and a draw-down was completed. The film was air dried and then dried in a convection oven for 20 minutes at 135° C. The thickness measured on a Heidenhain MT60M with digital display was 0.44 micron.

The charge generation, and a photogenerating and charge transport layers and photoconductive imaging member were prepared as described in Example IV.

EXAMPLE VII

Titanium Dioxide Sol-gel Blocking Layer 1.35 Microns Thick, 40 Percent by Weight Titanium Dioxide, 60 Percent by Weight Poly(ethylene glycol)

The titanium dioxide sol and coating solution were prepared as in Example VI. The dry thickness of the blocking layer was 1.35 microns measured with the Heidenhain MT60M.

The charge generation, and charge transport layers and photoconductive imaging member were prepared as described in Example IV.

EXAMPLE VIII

Titanium Dioxide Sol-gel Blocking Layer 0.61 Micron Thick, 30 Percent by Weight Titanium Dioxide. 70 Percent by Weight Poly(ethylene glycol)

The titanium dioxide sol was prepared as in Example VI. A solution of 40.01 grams total mass and 10.00 percent by weight total solids was prepared by magnetically stirring 2.80 grams of poly(ethylene)glycol of molecular weight 18,500 from Polysciences, 5.07 grams of a 23.70 percent by weight titanium dioxide sol prepared by the method just described and 32.14 grams of 18MΩ.cm deionized water. The solid, therefore, was 30 percent by weight titanium dioxide and 70 percent by weight poly(ethylene)glycol. The solution was coated onto a substrate consisting of vacuum evaporated titanium on 3 mil poly(ethylene terephthalate). A GARDCO® wet-film wire wound applicator rod available from Paul N. Gardner Company Ltd. was used to apply the solution to the substrate. The solution was added to the substrate using a disposable pipet near the rod and a draw-down was completed. The film was air dried and then dried in a convection oven for 20 minutes at 135° C. The thickness measured on a Heidenhain MT60M with digital display was 0.61 micron.

The charge generation, and charge transport layers and photoconductive imaging member were prepared as described in Example IV.

COMPARATIVE EXAMPLE IX

Blocking Layer of 0.4 Micron Polymeric Binder Only, No Nanocrystalline Sol-Gel Material A 10 percent by weight solution of Polysciences poly (ethylene glycol) of molecular, $M_w$, 18,500 in deionized distilled water was used for the hole blocking layer coating. A GARDCO® wet-film wire-wound applicator rod available from Paul N. Gardner Co. Ltd. was used to apply the solution to the substrate which was titanium coated polyethylene terephthalate. The film was air dried and then dried in a convection oven for 20 minutes at 135° C. The thickness measured on a Heidenhain MT60M with digital display was 0.4 micron.

The charge generation and charge transport layers, and photoconductive imaging member were prepared as described in Example IV.

COMPARATIVE EXAMPLE X

Blocking Layer Consisting of 0.6 micron Polymeric Binder Only, No Nanocrystalline Sol-Gel Material:

As Comparative Example IX, except the polyethylene glycol layer was 0.6 micron thick as measured with the Heidenhain MT60M.

COMPARATIVE EXAMPLE XI

Blocking Layer Consisting of Machine Coated Silane

A blocking layer of 0.025 micron (aminopropyl) trimethoxy silane on titanium coated polyethylene terephthalate was subsequently coated with the charge generation layer and charge transport layers as described in Example IV.

EXAMPLE XII

Xerographic Evaluation of Imaging Members

Imaging members fabricated in the above Examples were xerographically evaluated on a scanner fixture. The imaging members were electrostatically charged with a corona discharge source until the surface potentials, as measured by a capacitively coupled probe attached to an electrometer, attained an initial value $V_o$ of about −800 volts. After resting for 0.5 second in the dark, the charged member attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The desired wavelength and energy of the exposed light was determined by the type of filters placed in front of the lamp. A narrow-band pass filter of 780 nanometers was employed to create the monochromatic light for exposure and neutral density filters were used to vary the exposure energy. After being exposed and photodischarged to $V_{bg}$, the imaging member was further exposed with a more intense light of 780 nanometers and an intensity of about 45 ergs/cm$^2$ to reduce the surface potential to $V_{residual}$. The photoinduced discharge (PIDC) curve was then constructed by plotting $V_{bk}$ versus exposure energy. Photosensitivity is typically expressed as $E_{1/2}$ and $E_{7/8}$ values which represent the exposure energy required to discharge the imaging members from −800V to −400V, and −800V to −100V, respectively. The smaller the $E_{1/2}$ and $E_{7/8}$, the higher the photosensitivity of the imaging member. Low $V_{residual}$, typically <100 volts, is needed for achieving higher development potential required for a good latitude in the printing process. The results of the xerographic evaluation measurements of devices in Examples IV to XI are shown in Table 1. The results of Comparative Examples IX and X show that the devices with the undercoat layer with polyethylene glycol (PEG) only have very high residual voltages (215V and 297V) compared to Comparative Example XI with the silane (with a residual voltage of 3V). Examples IV to VIII illustrate sol gel undercoating layers with $TiO_2$ and PEG with a significant reduction in the residual voltage and $E_{1/2}$, for instance Examples IV and V (residual voltages 10V) and $E_{1/2}$ of 1.36 and 1.38, respectively, permitting achieving higher development potential and excellent latitude in the printing process.

TABLE 1

Xerographic Measurements of Devices in Examples IV to XI

| Under-coating Layer (UCL) | UCL | CTL Thick-ness (microns) | $V_{ddp}$ (V) | $E_{1/2}$ (ergs/cm$^2$ | $E_{7/8}$ (ergs/cm$^2$ | $V_{residual}$ (V) |
|---|---|---|---|---|---|---|
| Example IV | 0.37 μm, 50:50% w/w $TiO_2$:PEG | 24 | 815 | 1.36 | 2.93 | 10 |
| Example V | 0.59 μm, 50:50% w/w $TiO_2$:PEG | 24.5 | 820 | 1.38 | 2.92 | 10 |
| Example VI | 0.44 μm, 40:60% w/w $TiO_2$:PEG | 25 | 815 | 1.87 | 4.80 | 12 |
| Example VII | 1.35 μm, 40:60% w/w $TiO_2$:PEG | 20 | 810 | 1.89 | 4.84 | 13 |
| Example VIII | 0.61 μm, 30:70% w/w $TiO_2$:PEG | 25 | 805 | 2.19 | N/A | 92 |
| Comparative Example IX | 0.4 μm, PEG only | 24 | 810 | 5.8 | N/A | 215 |
| Comparative Example X | 0.6 μm, PEG only | 24 | 815 | 6.5 | N/A | 297 |

TABLE 1-continued

Xerographic Measurements of Devices in Examples IV to XI

| Under-coating Layer (UCL) | UCL | CTL Thick-ness (microns) | $V_{ddp}$ (V) | $E_{1/2}$ (ergs/cm$^2$ | $E_{7/8}$ (ergs/cm$^2$ | $V_{residual}$ (V) |
|---|---|---|---|---|---|---|
| Comparative Example XI | <0.1 μm, Silane | 24.5 | 835 | 1.35 | 2.85 | 3 |

EXAMPLE XIII

Xerographic Evaluation of Imaging Members, Cycling Test

In a cycling test, photoreceptor devices prepared as described in Examples IV, V and Comparative Example XI were charged with a corotron to about −800 volts. They were exposed with 775 nanometers of light with an intensity of about 7 ergs/cm$^2$ and erased with white light of about 60 ergs/cm$^2$. The dark development potential $V_{ddp}$ and residual potentials $V_{residual}$ were measured and recorded while the testing was performed for 10,000 cycles. The results of the xerographic cycling tests are shown in Table 2 and indicate excellent cycling stability due to small changes in $V_{ddp}$ and $V_{residual}$.

TABLE 2

Xerographic Cycling Data

| Undercoating Layer (UCL) | UCL Thickness (microns) | $\Delta V_{ddp}$ (V) | $\Delta V_{residual}$ (V) |
|---|---|---|---|
| Comparative Example XI | <0.1 Silane | −18 | 5 |
| Example IV | 0.37, 50:50% w/w $TiO_2$:PEG | −20 | 5 |
| Example V | 0.59, 50:50% w/w $TiO_2$:PEG | −22 | 8 |

EXAMPLE XIV

Particle Size of Titanium Dioxide Sol by Transmission Electron Microscopy

The particle size of the titanium dioxide sol prepared in Example IV was determined by transmission electron microscopy (TEM). Titanium dioxide, anatase crystal form, (ALFA®, AESAR®—A Johnson Matthey Co.) was used as a reference material. Approximately 1 milligram of powder of each of the reference and the sol were dispersed into separate tubes containing approximately 2 milliliters of butanol. The resulting powders in butanol were sonicated for 2 minutes to disperse. A droplet of 0.05 milliliter of the titanium dioxide in butanol was removed from the dispersion by micropipette and was placed onto a carbon-formvar coated copper grid. The titanium dioxide reference and the titanium dioxide sol of Example IV were examined in transmission on a Philips CM20 SEM instrument at an accelerating voltage of 120 kV The particle size was measured from the resulting photomicrographs.

Results indicate that the particle size of the reference titanium dioxide, anatase form ranges from 50 to 300 nanometers (0.05 micron to 0.3 micron) while the titanium dioxide sol of Example IV has a reduced particle size of 15 to 40 nanometers (0.015 to 0.04 micron).

EXAMPLE XV

X-ray Powder Diffraction of Titanium Dioxide Sol

The crystal form of the sol can be obtained by X-ray powder diffraction (XRPD) using approximately 1 gram of dry ground powder or a film coated on a glass slide. Typically traces are generated on a Philips X-Ray Powder Diffractometer Model 1710 using X-radiation of CuKα wavelength (λ=0.1542 nanometers). The diffractometer was equipped with a graphite monochromator and pulse height discrimination system. Two-theta is the Bragg angle commonly referred to in x-ray crystallographic measurements. I (counts) represents the intensity of the diffraction as a function of Bragg angle as measured with a proportional counter. Titanium dioxide has three crystal forms, anatase, rutile and brookite. The reference titanium dioxide, (ALFA®, AESA®—A Johnson Matthey Co.) anatase crystal form, XRPD showed peaks located at 25.2, 48.1, 37.8, 53.9, 55.0, 37.0, 38.6 two theta as noted from maximum to minimum intensities. The dried titanium dioxide sol from Example IV showed major peaks in the same positions as the reference titanium dioxide-anatase although the smaller peaks were unresolved. This would indicate that the titanium dioxide sol is also anatase crystal form. The broadening of XRPD peaks is generally related to a reduction in crystallite size typical of materials <0.1 micron. To determine the degree of peak broadening, a measurement of the maximum intensity XRPD peak at 25.2 degrees 2-theta was made on the reference titanium dioxide-anatase and the titanium dioxide sol. A measurement of the full width of the peak at half the maximum intensity, FWHM, was made. The reference titanium dioxide-anatase had a FWHM of 0.21 degrees 2-theta while the titanium dioxide -anatase sol had a FWHM of 1.8 degrees 2-theta. The FWHM of a peak is inversely proportional to the crystallite size. Therefore, the reference titanium dioxide-anatase had a larger crystallite size than the titanium dioxide-anatase sol.

Other embodiments and modifications of the present invention may occur to those skilled in the art subsequent to a review of the information presented herein; these embodiments and modifications, as well as equivalents thereof, are also included within the scope of this invention.

What is claimed is:

1. A photoconductive imaging member comprised of a supporting substrate, a hole blocking layer thereover, a photogenerating layer and a charge transport layer, and wherein the hole blocking layer is comprised of metal oxide particles prepared by a sol-gel process, and wherein said metal oxide particles are of a diameter of from about 1 to about 1,000 nanometers.

2. A member in accordance with claim 1 wherein said sol is nanocrystalline and contains particles of a size of from about 1 to about 1,000 nanometers.

3. A member in accordance with claim 2 wherein said nanocrystalline sol contains particles of a size of from about 100 to about 500 nanometers in diameter as measured by transmission electron microscopy.

4. A member in accordance with claim 1 wherein said hole blocking layer is comprised of about 1 to about 100 percent by weight of said nanocrystalline metal oxide and from about 0.5 to about 99 percent by weight of a polymeric binder.

5. A member in accordance with claim 1 wherein said hole blocking layer generated by said sol-gel process is comprised of about 30 to about 70 percent by weight of said metal oxide and about 30 to about 70 percent by weight of a polymeric binder.

6. A member in accordance with claim 1 wherein said hole blocking layer is of a thickness of about 0.1 to about 5 microns.

7. A member in accordance with claim 1 wherein said hole blocking layer is of a thickness of about 1 to about 2 microns.

8. A member in accordance with claim 1 wherein the photogenerating layer is comprised of phthalocyanines, perylenes, dibromoanthranthone, azo pigments, or selenium.

9. A member in accordance with claim 1 wherein the photogenerating layer is comprised of metal free phthalocyanines, metal phthalocyanines, titanyl phthalocyanines, hydroxygallium phthalocyanines, or alkoxide gallium phthalocyanines.

10. A member in accordance with claim 1 wherein the photogenerating layer is comprised of perylenes, benzimidazole perylene or perylene dimers.

11. A photoconductive imaging member in accordance with claim 1 comprised in the following sequence of a supporting substrate, said hole blocking layer, said photogenerating layer and said charge transport layer.

12. An imaging member in accordance with claim 1 wherein the supporting substrate is comprised of a conductive substrate comprised of a metal.

13. An imaging member in accordance with claim 12 wherein the conductive substrate is aluminum, aluminized polyethylene terephthalate or titanized polyethylene terphthalate, metallized plastics or transparent conductive substrates.

14. An imaging member in accordance with claim 1 wherein said photogenerator layer is of a thickness of from about 0.05 to about 10 microns.

15. An imaging member in accordance with claim 1 wherein said transport layer is of a thickness of from about 10 to about 50 microns.

16. An imaging member in accordance with claim 1 wherein the photogenerating layer is comprised of photogenerating pigments dispersed in a resinous binder, and wherein said pigments are present in an amount of from about 5 percent by weight to about 95 percent by weight.

17. An imaging member in accordance with claim 16 wherein the resinous binder is selected from the group consisting of polyesters, polyvinyl butyrals, polycarbonates, polystyrene-b-polyvinyl pyridine, and polyvinyl formals.

18. An imaging member in accordance with claim 1 wherein said charge transport layer comprises aryl amine molecules.

19. An imaging member in accordance with claim 1 wherein said charge transport layer is comprised of amines of the formula

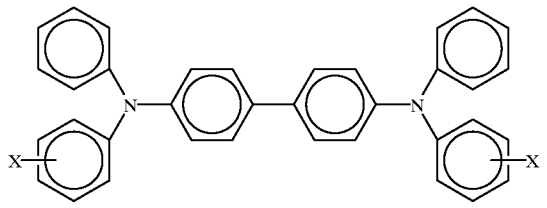

wherein X is selected from the group consisting of alkyl and halogen, and wherein the said amine is optionally dispersed in a highly insulating and transparent resinous binder.

20. An imaging member in accordance with claim 19 wherein alkyl contains from about 1 to about 10 carbon atoms.

21. An imaging member in accordance with claim 19 wherein alkyl contains from 1 to about 5 carbon atoms.

22. An imaging member in accordance with claim 19 wherein alkyl is methyl, wherein halogen is chloride, and wherein the resinous binder is selected from the group consisting of polycarbonates and polystyrenes.

23. An imaging member in accordance with claim 19 wherein the aryl amines are molecules comprised of N,N'-diphenyl-N,N-bis(3-methyl phenyl)-1,1'-biphenyl-4,4'-diamine.

24. An imaging member in accordance with claim 1 further including an adhesive layer in contact with said hole blocking layer, and which adhesive layer is comprised of a polyester.

25. A member in accordance with claim 24 wherein said polyester possesses an $M_w$ of about 69,000, and an $M_n$ of from about 10,000 to about 100,000.

26. An imaging member in accordance with claim 1 wherein the photogenerating layer is comprised of Type V hydroxygallium phthalocyanine.

27. A method of imaging which comprises generating an electrostatic latent image on the imaging member of claim 1, developing the latent image, and transferring the developed electrostatic image to a suitable substrate.

28. A photoconductive imaging member comprised in sequence of a supporting substrate, a hole blocking layer thereover, a photogenerating layer and a charge transport layer, and wherein the hole blocking layer is comprised of a nanocrystalline metal oxide particles prepared by a sol-gel process.

29. A member in accordance with claim 1 wherein said hole blocking layer prepared by said sol-gel process is comprised of about 1 to about 100 percent by weight of nanocrystalline metal oxide particles of about 1 to about 1,000 nanometers in diameter, and which particles are present in a polymeric binder, and wherein said metal oxides are comprised of the transition metals of scandium (Sc), titanium (Ti), vanadium (V), chromium (Cr), manganese (Mn), iron (Fe), cobalt (Co), nickel (Ni), copper (Cu), zinc (Zn), yttrium (Y), zirconium (Zr), niobium (Nb), molybdenum (Mo), technetium (Tc), ruthenium (Ru), rhodium (Rh), palladium (Pd), silver (Ag), cadmium (Cd), hafnium (Hf), tantalum (Ta), tungsten (W), rhenium (Re), osmium (Os), iridium (Ir), platinum (Pt), gold (Au), mercury (Hg), unnilquadium (Unq), unnilpentium (Unp) and unnilhexium (Unh inner transition elements of lanthanides of lanthanum (La) cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu); actinides of actinium (Ac), thorium (Th), protactinium (Pa), uranium (U), neptunium (Np), plutonium (Pu), americium (Am), curium (Cm), berkelium (Bk), californium (Cf), einsteinium (Es), fermium (Fm), mendelevium (Md), nobelium (No) and lawrencium (Lr); perovskites of $SrTiO_3$, $CaTiO_3$; oxides of metals of the second main group (of the periodic system of elements) of beryllium (Be), magnesium (Mg), calcium (Ca), strontium (Sr), barium (Ba), radium (Ra) and the third main group (of the periodic system of elements) of boron (B), aluminum (Al), gallium (Ga), indium (In) and thallium (Tl).

30. A member in accordance with claim 29 wherein the oxide is titanium dioxide.

31. A member in accordance with claim 29 wherein the oxide is anatase titanium dioxide.

32. A member in accordance with claim 29 wherein the polymeric binder is an acrylic polymer of poly(acrylic acid), a polyimine, poly(ethylene oxide), poly(ethylene glycol), poly(propylene oxide) or poly(propylene glycol), a polyalcohol of poly(vinyl alcohol), a polyether, a polyester, a silicone, a polycarbonate, a polyamide of nylon, vinyl polymers of poly(vinyl butyral), vinylidene chloride, vinyl chloride-vinyl acetate copolymer, ethylene-vinyl acetate copolymer, poly(vinylpyrrolidone), poly(vinylpyrridine), hydroxypropyl cellulose, methyl cellulose and ethyl cellulose, starch, polysaccharides or proteins.

33. A member in accordance with claim 32 wherein said binder is a vinyl polymer of poly(vinyl alcohol), or poly (vinylbutyral).

34. A member in accordance with claim 28 wherein whole blocking layer further contains a polymeric binder.

35. An imaging member in accordance with claim 34 wherein said polymeric binder is an acrylic polymer of poly(acrylic acid), a polyimine, poly(ethylene oxide), poly (ethylene glycol), poly(propylene oxide) or poly(propylene glycol), a polyalcohol of poly(vinyl alcohol), a polyether, a polyester, a silicone, a polycarbonate, a polyamide of nylon, vinyl polymers of poly(vinyl butyral), vinylidene chloride, vinyl chloride-vinyl acetate copolymer, ethylene-vinyl acetate copolymer, poly(vinylpyrrolidone), poly (vinylpyrridine), hydroxypropyl cellulose, methyl cellulose and ethyl cellulose, starch, polysaccharides or proteins.

36. An imaging member in accordance with claim 4 wherein said polymeric binder is polyethyleneglycol.

37. A photoconductive imaging member comprised of a supporting substrate, a hole blocking layer thereover, a photogenerating layer and a charge transport layer, and wherein the hole blocking layer is comprised of metal oxide particles prepared by a sol-gel process, and wherein said metal oxide particles are of a diameter of from about 1 to about 1,000 nanometers, and wherein hole blocking layer further contains a polymeric binder.

38. An imaging member in accordance with claim 37 wherein said polymeric binder is polyethyleneglycol.

39. A photoconductive imaging member consisting essentially of a supporting substrate, a hole blocking layer thereover, a photogenerating layer and a charge transport layer, and wherein the hole blocking layer is comprised of metal oxide particles prepared by a sol-gel process, and wherein said metal oxide particles are of a diameter of from about 1 to about 1,000 nanometers, and wherein hole blocking layer further contains a polymeric binder.

* * * * *